US007578273B2

(12) United States Patent
Meintschel et al.

(10) Patent No.: US 7,578,273 B2
(45) Date of Patent: Aug. 25, 2009

(54) DEVICE FOR ADJUSTING THE PHASE ANGLE BETWEEN TWO ROTATING, DRIVE-CONNECTED ELEMENT

(75) Inventors: Jens Meintschel, Esslingen (DE); Thomas Stolk, Kirchheim (DE); Alexander Von-Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 11/715,837

(22) Filed: Mar. 8, 2007

(65) Prior Publication Data

US 2007/0199532 A1 Aug. 30, 2007

Related U.S. Application Data

(63) Continuation-in-part of application No. PCT/EP2005/009275, filed on Aug. 27, 2005.

(30) Foreign Application Priority Data

Sep. 9, 2004 (DE) ..... 10 2004 043 548

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,680,837 | A | 10/1997 | Pierik et al. | |
| 6,058,897 | A | 5/2000 | Nakoyoshi | |
| 6,453,860 | B1 * | 9/2002 | Hase | 123/90.17 |
| 6,805,081 | B2 * | 10/2004 | Watanabe et al. | 123/90.17 |
| 2002/0017257 | A1 * | 2/2002 | Axmacher et al. | 123/90.17 |
| 2002/0043231 | A1 | 4/2002 | Hase | |
| 2005/0028773 | A1 * | 2/2005 | Komaki | 123/90.17 |

FOREIGN PATENT DOCUMENTS

| | | | |
|---|---|---|---|
| DE | 199 14 767 | A1 | 10/1999 |
| DE | 600 13 549 | T2 | 8/2001 |
| DE | 601 02 970 | T2 | 9/2001 |
| DE | 100 38 354 | A1 | 2/2002 |
| DE | 101 27 168 | A1 | 2/2002 |
| DE | 102 20 687 | A1 | 11/2003 |
| DE | 102 24 446 | A1 | 12/2003 |
| DE | 102 57 706 | A1 | 1/2004 |
| DE | 102 48 355 | A1 | 4/2004 |
| DE | 103 32 264 | A1 | 2/2005 |
| EP | 1 128 026 | A | 8/2001 |

* cited by examiner

*Primary Examiner*—Zelalem Eshete
(74) *Attorney, Agent, or Firm*—Klaus J. Bach

(57) ABSTRACT

In a device for adjusting the phase angle between two rotating, drive-connected elements, which are interconnected by means of an adjustment device, a control arrangement is provided for the energy-saving adjustment of the phase angle based on an alternating torque of one element which is also used in the event of a fault, to provide for an emergency operation in which the relative angular phase position between the two elements is kept essentially constant.

16 Claims, 4 Drawing Sheets

DEVICE FOR ADJUSTING THE PHASE ANGLE BETWEEN TWO ROTATING, DRIVE-CONNECTED ELEMENT

This is a Continuation-In-Part Application of pending International Patent Application PCT/EP2005/009275 filed Aug. 27, 2005 and claiming the priority of German Patent Application 10 2004 043 548.0 filed Sep. 9, 2004.

BACKGROUND OF THE INVENTION

The invention relates to a device for adjusting the phase angle between two rotating, drive-connected elements with an adjustment device arranged between the two rotating elements.

Devices of this type are known, for example, in internal combustion engines and are provided there for the relative adjustment of the phase angle of the camshaft and a crankshaft which drives the camshaft. This engagement in the valve drive kinematics influences the phase angle of the valve opening, the opening period and the valve stroke in a variable fashion within limits.

Known hydraulic camshaft actuators for adjusting a phase angle of a camshaft, which activates the valves of an internal combustion engine, comprise essentially a hydraulic motor which is fed by the motor oil circuit, operating for example according to the vane cell principle. Electric camshaft actuators composed of a summing gear mechanism and rotational actuator have recently become known in which an electric motor or an electric brake serves as the rotational actuator. All the systems have to place the phase angle of the camshaft in a defined emergency running position if faults occur in the electronics, that is if electric cables, or sensor systems or the actuator systems fail, or if the electric motor, the brake and the like become inoperative to ensure that the internal combustion engine remains operative although with restrictions. In hydraulic camshaft actuators with their typically small actuating ranges, this emergency running position is generally located at an end stop of the camshaft actuator. As a result of the average camshaft torque, these camshaft actuators generally move without an oil supply to the late stop, which may be, for example, the emergency operating position for an inlet valve of the internal combustion engine. If the "early" stop is the emergency operating position which is to be set, a restoring spring usually disposed between the chain wheel and camshaft comes into use. To avoid noise, the camshaft actuator is generally locked in the emergency running position.

In order to ensure the operation of internal combustion engines with camshaft actuators with an extended actuating range in the event of an emergency, an emergency operating position between the stops should expediently be provided. This may be done, for example, by means of two rotational springs, one operating counter to the other, between the chain wheel and camshaft whose effect is canceled out in the emergency operating position. However, during normal operation the camshaft actuator must operate continuously counter to these springs with the result that its power drain in terms of pressurized motor oil or electric current is in some cases considerably increased.

German laid-open patent application DE 102 20 687 discloses a device for adjusting the angle between two rotating, drive-connected elements in which, in the event of a failure of the adjustment device and/or its controller, an emergency position can be reached and held by braking and locking the adjustment shaft and by rotating the drive shaft with a suitable transmission ratio.

It is the principle object of the invention to provide a low power consumption device for adjusting the angle between two rotating, drive-connected elements which permits an emergency running position to be reliably adopted and held.

SUMMARY OF THE INVENTION

In a device for adjusting the phase angle between two rotating, drive-connected elements, which are interconnected by means of an adjustment device, means are provided for the energy-saving adjustment of the phase angle based on an alternating torque of one element which is also used in the event of a fault, to provide for an emergency operation in which the relative angular phase position between the two elements is kept essentially constant.

To this end, a non-uniform torque profile on the adjustment device which is caused, for example, by valve actuation by a camshaft can be utilized. Herein, a braking effect is generated when the valves are the actuation cams. During closing, the valves generate a force effective on the rear cam areas resulting in a forward rotating force or torque effective on the camshaft.

For the purpose of adjustment in the event of a fault, a free-wheeling-like mechanism with a one-sided locking means which acts as a function of the camshaft angle is preferably provided. The mechanism makes it possible to use the alternating torque of an element for relative angular adjustment between the two elements in order to assume an emergency operative position. The free-running-like mechanism is preferably embodied as a latch mechanism in such a way that a spring-loaded latch can be moved on a tooth structure of a corresponding element, which tooth structure permits the latch to move in a first free-running direction. In this way the latch can be moved in a defined direction. The latch is pressed onto the tooth structure by a spring. If a sufficiently large alternating torque acts between a bearing of the latch and the corresponding element which supports the tooth structure, the latch can slide on a flat tooth edge of the tooth structure and jump into a following tooth gap. A movement in a direction counter to the free-running direction can be excluded by a correspondingly steep tooth edge. The process continues until a tooth gap with steep tooth edges on both sides is reached. If the emergency operating position to be adopted is located between end stops of the adjustment device, tooth structures which each act in opposite directions can expediently be obtained on each side of the emergency operating position. The emergency operating position can then be reached very quickly since, for example, in the case of a four cylinder internal combustion engine components of the alternating torque which also rotate four times and brake four times within one revolution of the camshaft also occur, and the preferred latch mechanism is able to move on by four teeth in the process.

The emergency running position is preferably arranged in a tooth gap at which two tooth structures with opposing free-running directions of the latch meet. The emergency running position can thus be reliably reached and the latch secured in the tooth gap until, in order to initiate actuating processes, an operative connection between the latch and tooth structure the latch will be moved out of the tooth structure.

The free-running-like mechanism is advantageously arranged in such a way that the alternating torque acts between a bearing of the latch and the corresponding element which supports the tooth structure.

In one preferred embodiment the tooth structure is arranged in a hydraulic adjustment device with a hydraulic motor including a vane cell element, on an impeller wheel which is connected in a rotationally fixed fashion to the first element. The latch is preferably connected in a rotationally fixed fashion to the second element, with the latch being preferably radially movable. The preferred latch mechanism is compact and does not require any additional installation space. The latch mechanism can be combined with existing components.

In one favorable embodiment, the tooth structure of a hydraulic adjustment device with a hydraulic motor with a vane cell element is connected in a rotationally fixed fashion to the second element. The latch is preferably arranged on an impeller wheel which is connected in a rotationally fixed fashion to the first element, with the latch being preferably axially movable. The preferred latch mechanism is compact and does not require any additional installation space.

In a hydraulic adjustment device, a modified hydraulic valve whose chambers can be emptied in the event of a fault is expediently provided. It is then impossible for residual oil which may be present in the vane cells to prevent the emergency running position from being adopted.

In another favorable embodiment in an electric adjustment device, the tooth structure is connected in a rotationally fixed fashion to an actuating shaft of a gear drive, the first element being connected to the second element by means of the gear drive which has the actuating shaft. The electric adjustment device comprises an electric rotational actuator and a gearbox. The gear drive is preferably embodied as a summing gear mechanism with three shafts, two inputs and one output. If two of the three shafts are connected to one another in a rotationally fixed fashion, the gear drive is locked and the phase angle remains constant.

In a further favorable embodiment, the tooth structure in an electric adjustment device is connected in a rotationally fixed fashion to an output of a gear drive, the first element being connected to the second element by means of the gear drive which has the actuating shaft.

In a further favorable embodiment in an electric adjustment device, the tooth structure is arranged in a gear drive, the first element being connected to the second element by means of the gear drive which has an actuating shaft.

In an electric adjustment device, it is particularly favorable if during normal operation the latch can be lifted off from the tooth structure by magnetic force so that an adjustment process can be initiated.

If the electric adjustment device is embodied as an electric motor, a separate electric magnet can be provided for lifting off the latch from the tooth structure, the coil of which can be connected electrically in series or in parallel with the adjustment device.

If the electric adjustment device is embodied as a hysteresis brake, the latch can be arranged with a favorably small degree of structural expenditure in such a way that it can be lifted off from the tooth structure by the magnetic flux of the hysteresis brake.

The invention will be explained in more detail below on the basis of exemplary embodiments described with reference to accompanying drawings.

DESCRIPTION OF PARTICULAR EMBODIMENTS

The invention is particularly suitable for a camshaft actuator with which a phase angle of the camshaft can be varied compared to a drive, for example a chain wheel, which can be driven by a crankshaft of an internal combustion engine.

In the figures, identical or substantially identically acting elements are provided with the same reference symbols.

Figure 1A:
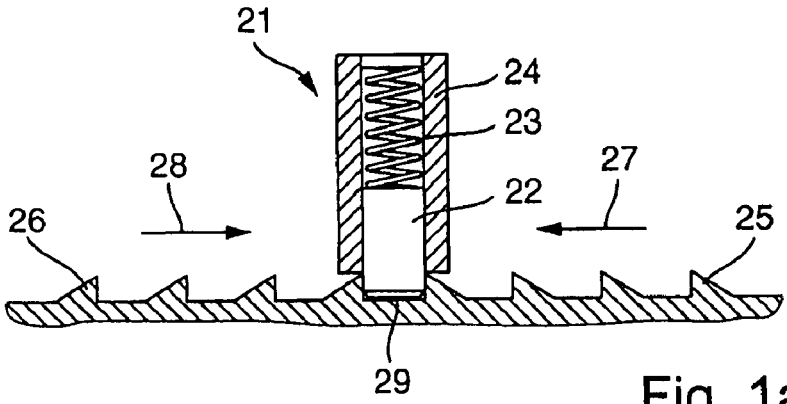
FIGS. 1*a* and 1*b* show a preferred latching mechanism with a tooth structure which is illustrated in a developed view in an emergency operating position (1*a*) and during movement in the direction of the emergency operating position (b)
Figure 1B:
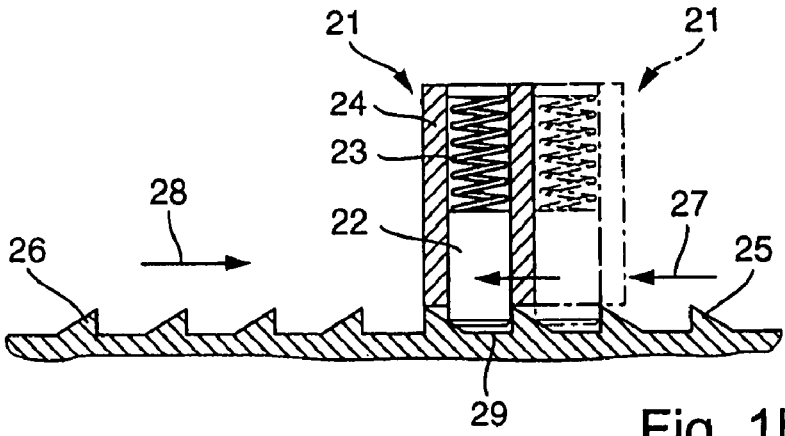

As is illustrated in FIGS. 1*a*, and 1*b*, a preferred free-running-like mechanism which is embodied as a latch mechanism 21 comprises a latch member 22 in a guide 24, the latch member 22 being pressed by a spring 23 onto a tooth structure 25, 26 which is illustrated in a developed view. The latch member 22 is arranged in a tooth gap 29 in an emergency operating position in FIG. 1*a*, and in FIG. 1*b* a movement of the latch member 22 in the direction of the emergency running position is illustrated. The tooth structure 25 or 26 has flat tooth side edges the teeth rising gradually in the free-running direction 27 or 28 of the tooth structure 25 or 26, while the trailing edges are arranged in a significantly steeper, preferably perpendicular fashion. The latch member 22 can slide over the tooth structure 25 in the free-running direction 27, or over the tooth structure 26 in the free-running direction 28. In FIG. 1*b*, it can be seen how the latch member 22 slides over a tooth from a tooth gap in the free-running direction 27 and drops into the next tooth gap. If the latch member 22 reaches the tooth gap 29, it has reached the emergency running position. The tooth structures 25, 26 which have opposed free-running directions 27, 28 bound the tooth gap 29 on both sides. The tooth gap 29 is bounded on both sides by steep tooth edges in such a way that the latch member 22 cannot slide out of the tooth gap 29 counter to the spring pressure of the spring 24. In order to interrupt an operative connection between the latch member 22 and the tooth structures 25, 26 during normal operation and to initiate an adjustment process, the latch member 22 must be lifted off from the tooth structure 25, 26.

Figure 2:
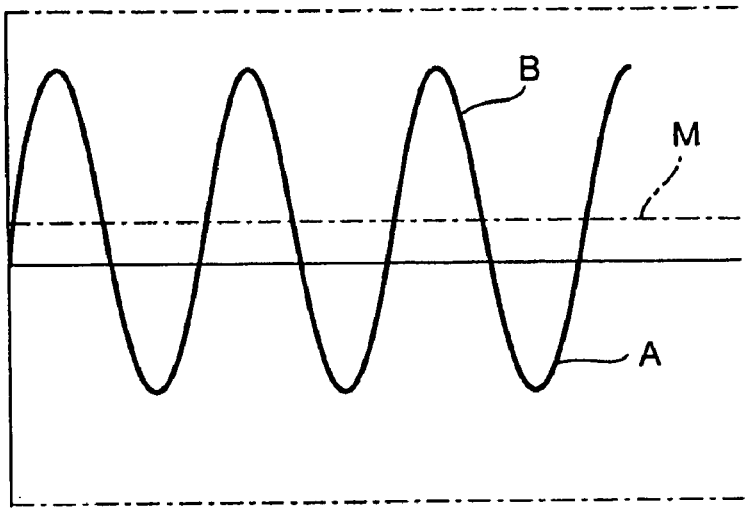
FIG. 2 shows a profile of an alternating torque of a camshaft plotted against a crankshaft.

The movement of the latch member 22 in the free-running direction 27 or 28 is made possible by an alternating torque which acts between a bearing of the latch member 22 and a corresponding element which supports the tooth structure 25, 26. The profile of the alternating torque of a camshaft plotted against a crank angle is outlined in FIG. 2. The torque profile which is recognizably non-uniform can be felt on an adjustment device of the camshaft. The peaks in the positive direction correspond to braking components B which arise as a result of valve activation cams of the camshaft when said valves open. When the valves close, they apply a force to the rear side edge of the cams, which forces give rise to then negative peaks, corresponding to simultaneously rotating components A. The average camshaft torque M is added to the image as a dashed constant line. The simultaneously rotating components A of the alternating torque can advantageously be used to drive the latch mechanism 21 in the event of a fault.

Figure 3:
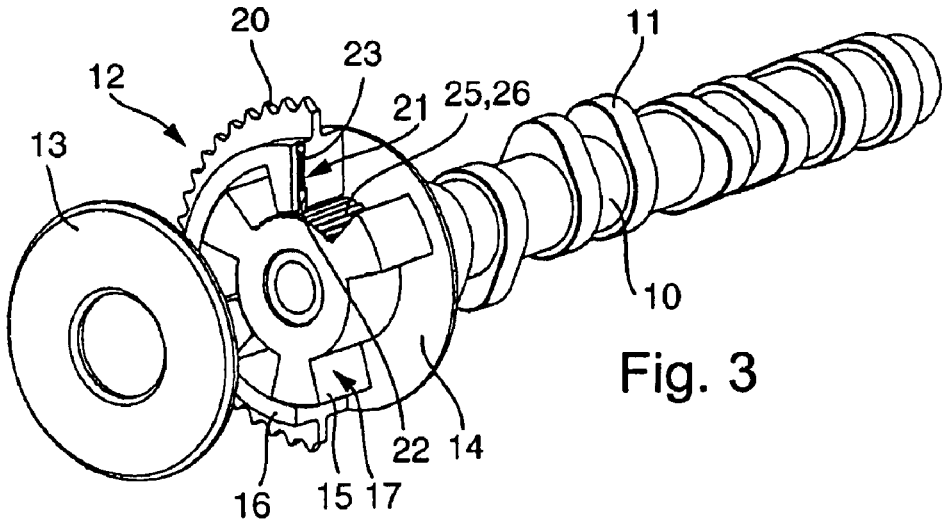
FIG. 3 is an exploded illustration of a hydraulic camshaft actuator based on a vane cell principle with a latch mechanism with a radially movable latch member.

FIG. 3 shows, in an exploded illustration, a preferred hydraulic camshaft actuator with a hydraulic motor based on the vane cell principle as an adjustment device 12 for adjusting the angle between two rotating, drive-connected elements 10, 20 which are interconnected by means of the adjustment device 12, with a latch mechanism 21 including a latch member 22. The adjustment device 12 comprises an impeller wheel 15 and an outer part 16, the vane cell element 17, which is in contact with an inner circumference of the second element 20 which is embodied as a chain wheel. The second element 20 can also be embodied as a pulley. The impeller wheel 15 is provided with a tooth structure 25, 26, as described in FIG. 1, and is connected in a rotationally fixed fashion to the first element 10 which is embodied as a camshaft. The spring-loaded latch member 22 of the preferred latch mechanism 21 is radially movable and in the event of a fault engages in the tooth structure 25, 26. The latch member 22 which moves radially inwards as a result of its spring 23 is connected in a rotationally fixed fashion to the outer part 16 of the second element 20 which is embodied as a chain wheel. The adjustment device 12, which is embodied as a hydraulic motor, is covered with a first cover plate 13 and a camshaft-end cover plate 14.

During normal operation, the latch member 22 is pressed by the oil pressure prevailing in the vane cells 12 in the direction of the spring 23 so that the latch member 22 is lifted off from the tooth structure 25, 26 and no contact occurs. If the adjustment device 12 which is embodied as a hydraulic motor fails, the oil pressure in the vane cells 17 also collapses. The latch member 22 then is biased toward the tooth structure 25, 26 under the effect of the spring 23, and the emergency running position is established as a result of the alternating torque. Since residual oil in the vane cells 17 can impede this process, it is advantageous if the vane cells 17 are emptied in an emergency operation. This can be done, for example, by means of a modified multi-path hydraulic valve which in addition to customary positions—filling direction 1/emptying direction 2, and filling direction 2/emptying direction 1 and holding—has a de-energized position in which both chambers are emptied.

Figure 4:
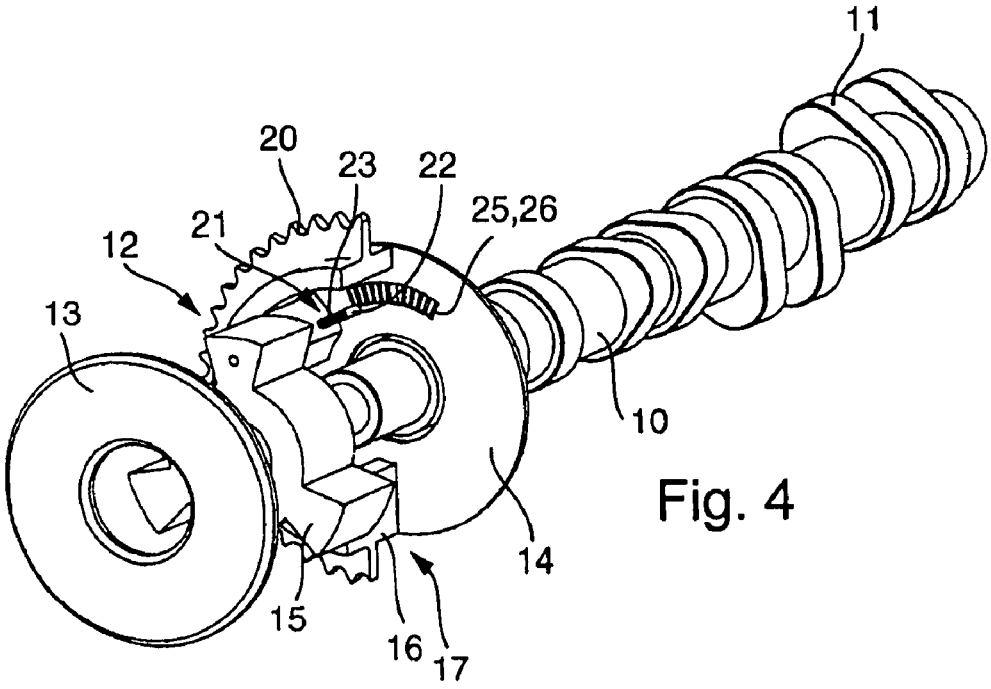
FIG. 4 is an exploded illustration of a hydraulic camshaft actuator based on the vane cell principle with a latch mechanism with an axially movable latch member.

An alternative embodiment with an axially movable latch member 22 is shown by FIG. 4. The design corresponds largely to the design in FIG. 3. For elements which are not explained in more detail here, reference is made to the description of FIG. 3. The latch member 22 is mounted in the impeller wheel 15 and acts on the second cover plate 14 in which the tooth structure 25, 26 is formed. The cover plate 14 is connected in a rotationally fixed fashion to the second element 20 which is embodied as a chain wheel. During normal operation, as described above, the latch member 22 is lifted off from the tooth structure 25, 26 by the oil pressure prevailing in the vane cells 17, and in the event of a fault when the oil pressure is absent it engages in the tooth structure 25, 26 and provides for the emergency running operation.

FIGS. 5*a*, 5*b*, 5*c* and 6 illustrate a plurality of preferred embodiments which have an electric adjustment device 12. The adjustment device 12 comprises an electric rotational actuator 30 and a gear drive 31. The rotational actuator 30 can be embodied as an electric motor or as a passive brake in the form of a hysteresis brake. The adjustment device 12 activates an actuating input 32 which acts on the gear drive 31 which is in particular a summing gear mechanism. The first element 10 is located at the output of the gear drive 31. The input of the gear drive 31 is formed by the second element 20, embodied as a drive. The drive can be embodied as a chain wheel or as a pulley. If two of the three inputs or outputs are connected to one another in a rotationally fixed fashion, the gear drive 31 is locked and the phase angle remains constant. A device for retracting a latch member 22 of a preferred latch mechanism 21, such as is described in FIG. 1, during normal operation is not illustrated. This can be done, for example, by means of an electric motor whose coil is connected electrically in series or in parallel with the electric adjustment device 12.

Figure 5A:
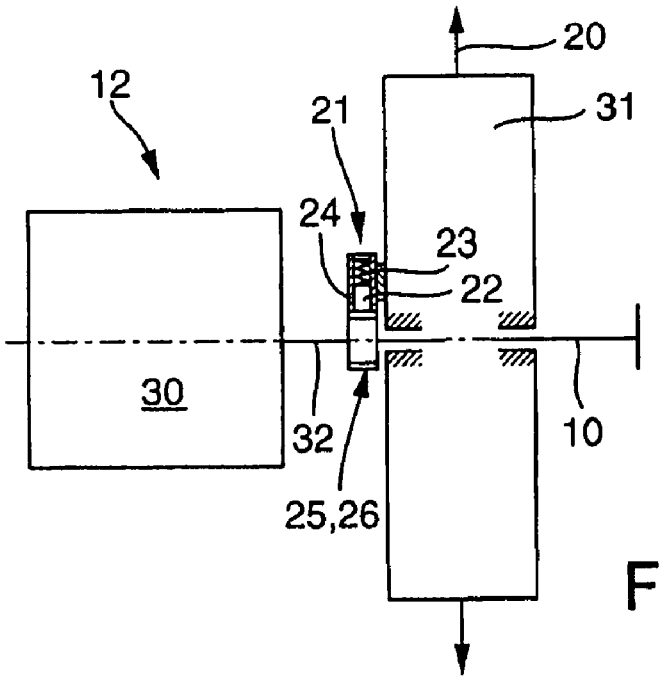
FIGS. 5*a*, 5*b*, and 5*c* show, in parts a, b, c, a schematically a latch mechanism between the actuating input and input (a), a latch mechanism between the input and output (b), a latch mechanism between the actuating input and output (c) in an electric camshaft actuator.
Figure 5B:
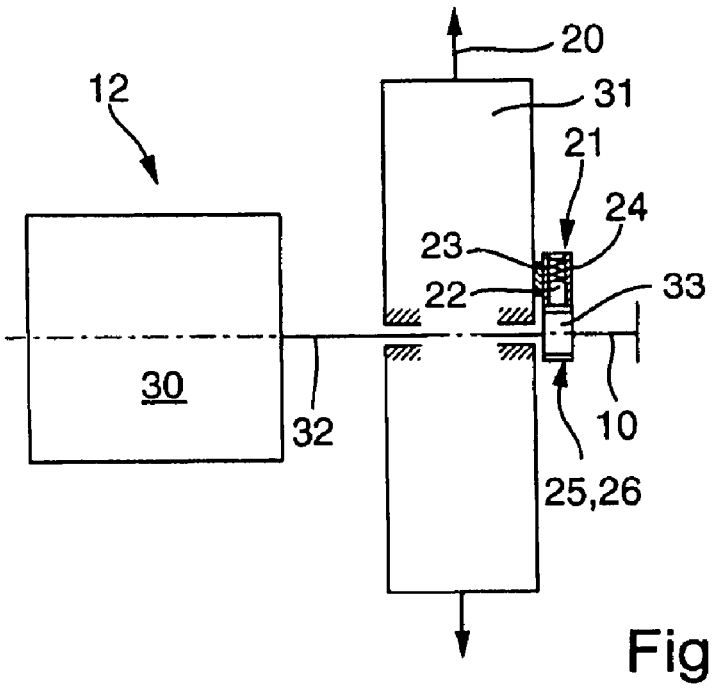
Figure 5C:
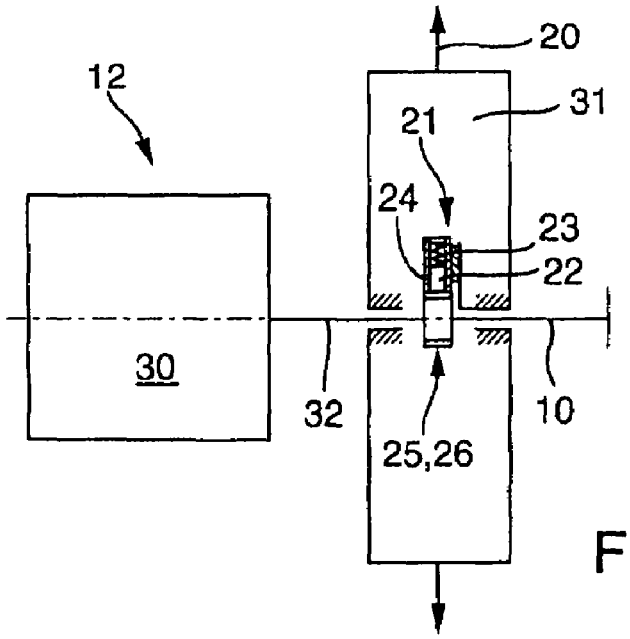

FIGS. 5*a*, 5*b*, 5*c* describe various arrangements of a preferred latch mechanism 21. In a first preferred arrangement, the latch mechanism 21 is arranged between the actuating input 32 of the gear drive 31 and the input of the gear drive 31 which is formed by the second element 20, the latch member 22 being connected by its guide 24 in a rotationally fixed fashion to the input, and the tooth structure 25, 26 being arranged on the actuating shaft (FIG. 5*a*). Alternatively, the latch mechanism 21 can be arranged between the aforesaid input of the gear drive 31 and the output of the gear drive 31 (FIG. 5*b*). In this context, the tooth structure 25, 26 is connected in a rotationally fixed fashion to the first element 10 which is embodied as a camshaft, and the latch is connected by its guide 24 to the gear drive housing which is connected in a rotationally fixed fashion to the second element 20. Alternatively, the latch mechanism 21 can also be arranged within the gear drive 31 between the actuating input 32 and the output of the gear drive 31, the latch being connected by its guide 24 in a rotationally fixed fashion to the output.

Figure 6:
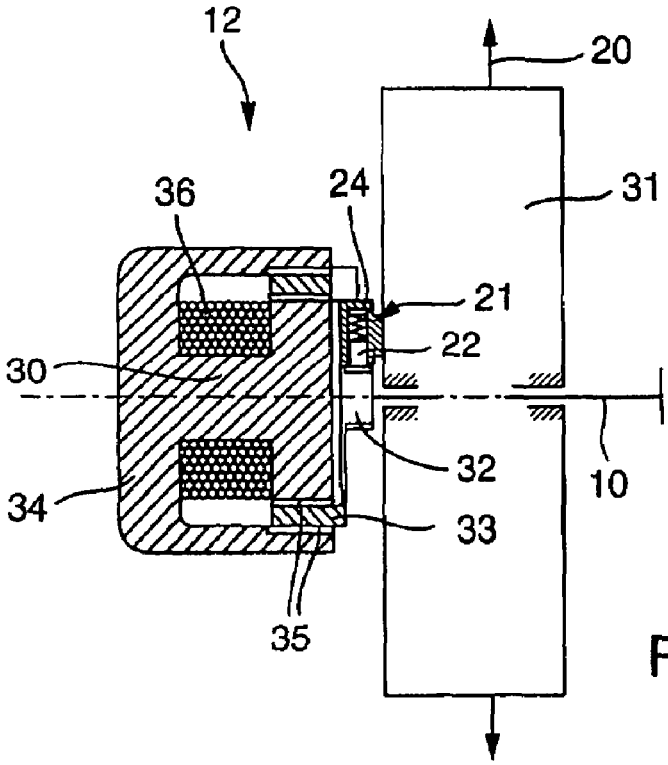
FIG. 6 is a schematic view of a latch mechanism between the actuating input and input in an electric camshaft actuator with a hysteresis brake.

FIG. 6 is a schematic view in an electric camshaft actuator with a latch mechanism 21 between the actuating input 32 and output of a gear drive 31 as described in FIG. 5, the rotational actuator 30 of the electric adjustment device 12 being embodied as a hysteresis brake. A coil 36 is arranged in a stator 34. If said coil 36 is energized, a hysteresis ring 33, which engages in a pole structure 35 which is itself embodied on both sides of a gap of the stator 34, is continuously re-magnetized, which brakes the hysteresis ring 33. Since the hysteresis ring 33 is connected by its carrier in a rotationally fixed fashion to the actuating input 32, the latter is likewise braked. The actuating input 32 supports the tooth structure 25, 26 while the latch is connected by its carrier 24 in a rotationally fixed fashion to the gear drive housing or the second element 20.

During the energization, the latch member 22 is forced out by the magnetic flux in the stator 34. The latch member 22 is therefore expediently formed from a soft magnetic or magnetizable material. If the stator 34 or its coil 36 is not energized, the spring 23 of the latch mechanism 21 presses the latch member 22 onto the tooth structure 25, 26.

What is claimed is:

1. A device for adjusting the phase angle between two elements (10, 20) comprising an adjustment device disposed between, and operatively interconnecting, the two elements (10, 20) for joined rotation at an adjustable phase angle and means for utilizing an alternating torque of one element (10) for establishing, in the event of a fault, a predetermined relative angular phase position between the two elements (10, 20) suitable for emergency operation, comprising a free-running mechanism (21) with a locking mechanism which uses the alternating torque of the one element (10) for relative angular adjustment between the two elements (10, 20) in order to reach the emergency running phase position.

2. The device as claimed in claim 1, wherein the free running mechanism (21) comprises a spring-loaded latch member (22) disposed on a tooth structure (25, 26) of a corresponding element (24, 32, 33), which tooth structure (25, 26) permits a direction of movement of the latch member (22) in a first free-running direction (27, 28), but blocks it in the other.

3. The device as claimed in claim 2, wherein the emergency running position is defined by a tooth gap (29) at which two tooth structures (25, 26) for opposing free-running directions (27, 28) of the latch member (22) meet.

4. The device as claimed in claim 2, wherein the free-running mechanism (21) is arranged in such a way that the alternating torque acts between a bearing of the latch member (22) and the corresponding element (24, 32, 33) which supports the tooth structure (25, 26).

5. The device as claimed in claim 2, wherein means are provided for lifting the latch member (22) during normal operation off from the tooth structure (25, 26) in order to release an operative engagement between the latch member (22) and tooth structure (25, 26).

6. The device as claimed in claim 2, wherein, in a hydraulic adjustment device (12) with a hydraulic motor including a vane cell element (17), the tooth structure (25, 26) is arranged on an impeller wheel (15) which is connected in a rotationally fixed fashion to the first element (10).

7. The device as claimed in claim 6, wherein the latch member (22) is connected in a rotationally fixed fashion to the second element (20).

8. The device as claimed in claim 2, wherein, in a hydraulic adjustment device (12) including a hydraulic motor with a vane cell element (17, the tooth structure (25, 26) is connected in a rotationally fixed fashion to the second element (20).

9. The device as claimed in claim 8, wherein the latch member (22) is arranged on an impeller wheel (15) which is connected in a rotationally fixed fashion to the first element (10).

10. The device as claimed in claim 6, wherein the hydraulic motor is a two-chamber hydraulic motor whose two chambers can be emptied in the event of a fault.

11. The device as claimed in claim 2, wherein, in an electric adjustment device (12), the tooth structure (25, 26) is connected in a rotationally fixed fashion to an actuating shaft (32) of a gear drive (31), the first element (10) being connected to the second element (20) by means of the gear drive (31) which has the actuating shaft (32).

12. The device as claimed in claim 2, wherein, in an electric adjustment device (12), the tooth structure (25, 26) is connected in a rotationally fixed fashion to an output (33) of a gear drive (31), the first element (10) being connected to the second element (20) by means of the gear drive (31) which has the actuating shaft (32).

13. The device as claimed in claim 2, wherein, in an electric adjustment device (12), the tooth structure (25, 26) is arranged in a gear drive (31), the first element (10) being connected to the second element (20) by means of the gear drive (31) which has an actuating shaft (32).

14. The device as claimed in claim 2, wherein during normal operation the latch member (22) can be lifted off from the tooth structure (25, 26) by magnetic force.

15. The device as claimed in claim 11, wherein the electric adjustment device (12) comprises an electric motor as rotational actuator (30).

16. The device as claimed in claim 11, wherein the electric adjustment device (12) comprises a hysteresis brake as a rotational actuator (30).

* * * * *